US009815610B2

(12) United States Patent
Yamada et al.

(10) Patent No.: US 9,815,610 B2
(45) Date of Patent: Nov. 14, 2017

(54) SQUEEZE CONTAINER

(71) Applicant: KAO CORPORATION, Tokyo (JP)

(72) Inventors: Takashi Yamada, Machida (JP); Yoshinori Inagawa, Chiba (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 15/108,529

(22) PCT Filed: Dec. 26, 2014

(86) PCT No.: PCT/JP2014/084593
§ 371 (c)(1),
(2) Date: Jun. 27, 2016

(87) PCT Pub. No.: WO2015/099146
PCT Pub. Date: Jul. 2, 2015

(65) Prior Publication Data

US 2016/0340106 A1 Nov. 24, 2016

(30) Foreign Application Priority Data

Dec. 27, 2013 (JP) ..... 2013-271048
Dec. 27, 2013 (JP) ..... 2013-271049
Dec. 27, 2013 (JP) ..... 2013-271050

(51) Int. Cl.
*B65D 83/00* (2006.01)
*B05C 17/005* (2006.01)
(Continued)

(52) U.S. Cl.
CPC ..... *B65D 83/0055* (2013.01); *B65D 35/14* (2013.01); *B65D 35/36* (2013.01);
(Continued)

(58) Field of Classification Search
CPC combination set(s) only.
See application file for complete search history.

(56) References Cited

U.S. PATENT DOCUMENTS 4,585,149 A 4/1986 Zulauf
6,679,642 B1 * 1/2004 Dillingham ..... A46B 11/0041 401/134
(Continued)

FOREIGN PATENT DOCUMENTS

CA 2162480 A1 11/1994
EP 2 113 308 A 11/2009
(Continued)

OTHER PUBLICATIONS

International Search Report dated Apr. 7, 2015, in PCT/JP2014/084593 Filed Dec. 26, 2014.
(Continued)

*Primary Examiner* — David Walczak
(74) *Attorney, Agent, or Firm* — Oblon, McClelland, Maier & Neustadt, L.L.P.

(57) ABSTRACT

A squeeze container (10) that includes a container body (13) including squeezable/deformable press-deforming portions (27), and that discharges a content contained in an inner bag (11) inside the outer container (13) by squeezing (pressing) the press-deforming portions (27). The outer container (13) has a tubular body portion (12) including: the press-deforming portions (27); and longitudinal-direction reinforcing portions (13*e*) molded integrally with the press-deforming portions (27). A pair of longitudinal-direction reinforcing portions (13*e*) is provided, the longitudinal-direction reinforcing portions extending in a longitudinal direction at respective two locations opposing one another in a radial direction of the tubular body portion (12). A pair of press-deforming portions (27) is provided, the press-deforming portions being arranged in respective sections between the pair of longitudinal-direction reinforcing portions (13*e*) so as to oppose one another, and each preferably having an arcuate cross-sectional shape so as to form the overall
(Continued)

circular hollow cross-sectional shape of the outer container (13).

15 Claims, 7 Drawing Sheets

(51) Int. Cl.

| | |
|---|---|
| ***B65D 35/14*** | (2006.01) |
| ***B65D 35/36*** | (2006.01) |
| ***B65D 35/46*** | (2006.01) |
| ***B65D 47/20*** | (2006.01) |
| *B65D 47/44* | (2006.01) |

(52) U.S. Cl.
CPC ..... *B65D 35/46* (2013.01); *B65D 47/20* (2013.01); *B05C 17/00583* (2013.01); *B65D 47/44* (2013.01)

(56) References Cited

U.S. PATENT DOCUMENTS

| | | | | |
|---|---|---|---|---|
| 6,837,390 | B2 * | 1/2005 | Lane | B65D 1/0223 215/381 |
| 6,976,600 | B2 * | 12/2005 | Yoneyama | B65D 1/0215 215/12.1 |
| 2003/0222100 | A1 | 12/2003 | Husband et al. | |
| 2013/0161341 | A1 | 6/2013 | Kneer | |

FOREIGN PATENT DOCUMENTS

| | | | |
|---|---|---|---|
| EP | 2 210 815 | A1 | 7/2010 |
| JP | 5-42118 | U | 6/1993 |
| JP | 5-51755 | U | 7/1993 |
| JP | 6-247432 | A | 9/1994 |
| JP | 8-156973 | A | 6/1996 |
| JP | 8-198233 | A | 8/1996 |
| JP | 10-86922 | A | 4/1998 |
| JP | 10-324342 | A | 12/1998 |
| JP | 11-268720 | A | 10/1999 |
| JP | 2004-210345 | A | 7/2004 |
| JP | 2007-308195 | A | 11/2007 |
| JP | 2011-157119 | A | 8/2011 |
| JP | 2013-28379 | A | 2/2013 |
| WO | 94/26624 | A1 | 11/1994 |

OTHER PUBLICATIONS

International Preliminary Report on Patentability and Written Opinion dated Jul. 7, 2016 in PCT/JP2014/084593 (English translation only).

Extended European Search Report dated Jul. 21, 2017 in corr. European Patent Application No. 14873467.6, dated Dec. 26, 2014.

* cited by examiner

SQUEEZE CONTAINER

CROSS REFERENCE TO RELATED APPLICATION

This application is a 371 of PCT/JP2014/084593, filed on Dec. 26, 2014, and claims priority to the following Japanese Patent Applications: i) 2013-271048, filed on Dec. 27, 2013; ii) 2013-271049, filed on Dec. 27, 2013; and iii) 2013-271050, filed on Dec. 27, 2013.

TECHNICAL FIELD

The present invention relates to a squeeze container, and particularly to a squeeze container that discharges a content by squeezing press-deforming portions of a container body.

BACKGROUND ART

Squeeze-type double delamination containers (e.g., Patent Literature 1) are known as examples of squeeze containers that discharge a content by squeezing (pressing) press-deforming portions of a container body. In a squeeze-type double delamination container, a flexible inner bag containing a content is attached to an inner portion of an outer container constituting the container body, and the content is caused to flow out while reducing the volume of the inner bag and deforming the bag without the replacement of air. When the operation for causing content outflow is finished, air is taken into a section between the outer container and the inner bag to restore the outer container to its original shape, thus preventing deformation of the outer container.

In the squeeze-type double delamination container of Patent Literature 1, the container body is formed by delaminably layering, by blow molding, a deflatable/deformable inner layer (inner bag) on the inner side of a flexible outer layer that is squeezable/deformable and restorable. Further, in the squeeze-type double delamination container of Patent Literature 1, the content liquid contained inside the inner layer is discharged by squeezing and deforming (pressing and deforming) the container body, and thereafter, when the squeezing operation is finished and the pressed state is released, outside air is introduced—via an air passage opening formed in a bottom sealed portion—between the outer layer and the inner layer while delaminating the two layers. Thus, the container body is restored to its original shape before being squeeze-deformed.

Also, squeeze-type or pump-type double delamination containers (e.g., Patent Literatures 1 and 2) are known as examples of double containers in which: a flexible inner bag containing a content is attached to an inner portion of an outer container, and the content is caused to flow out while reducing the volume of the inner bag and deforming the bag without the replacement of air; and when the operation for causing content outflow is finished, air is taken into a section between the outer container and the inner bag, to restore the outer container to its original shape and prevent deformation of the outer container.

In the squeeze-type double delamination container of Patent Literature 1, the container body is formed by delaminably layering a deflatable/deformable inner layer (inner bag) on the inner side of a flexible outer layer that is squeezable/deformable and restorable. In the squeeze-type double delamination container of Patent Literature 1, the content liquid contained inside the inner layer is discharged by squeezing and deforming (pressing and deforming) the container body, and thereafter, when the squeezing operation is finished and the pressed state is released, outside air is introduced, via an air passage opening, between the outer layer and the inner layer while delaminating the two layers. Thus, the container body is restored to its original shape before being squeeze-deformed.

The pump-type double delamination container of Patent Literature 2 is a delamination bottle including: an outer layer made of a hard synthetic resin; and an inner layer (inner bag) delaminable with respect to the outer layer. A pump dispenser is attached to a mouth portion of the delamination bottle. When content is discharged from inside the inner layer, air is taken in through a slit; thereby, as the content is discharged, the inner layer delaminates from the outer layer, and the volume inside the inner layer decreases. Thus, the content can be discharged while retaining the outer shape of the container by the outer layer.

CITATION LIST

Patent Literature

Patent Literature 1: JP 2004-210345A
Patent Literature 2: JP H11-268720A

SUMMARY OF INVENTION

The present invention relates to a squeeze container that includes a container body including squeezable/deformable press-deforming portions, the squeeze container discharging a content contained in the container body by squeezing of the press-deforming portions. The container body has a tubular body portion including: the press-deforming portions; and longitudinal-direction reinforcing portions molded integrally with the press-deforming portions. The press-deforming portions are made of a different material from the longitudinal-direction reinforcing portions. The longitudinal-direction reinforcing portions are provided as a pair, and extend in a longitudinal direction at respective two locations opposing one another in a radial direction of the tubular body portion. The press-deforming portions are provided as a pair, and arranged in respective sections between the pair of longitudinal-direction reinforcing portions so as to oppose one another.

BRIEF DESCRIPTION OF DRAWINGS

FIG. 4(*b*) is a perspective view illustrating a configuration of a double squeeze container according to a preferred embodiment of the invention in a state where the outer container has been removed.

FIG. 6(*b*) is a sectional view taken along line B-B of FIG. 6(*a*), illustrating another embodiment of the inner bag.

FIG. 6(*c*) is a sectional view taken along line C-C of FIG. 6(*a*), illustrating another embodiment of the inner bag.

DESCRIPTION OF EMBODIMENTS

Figure 1:
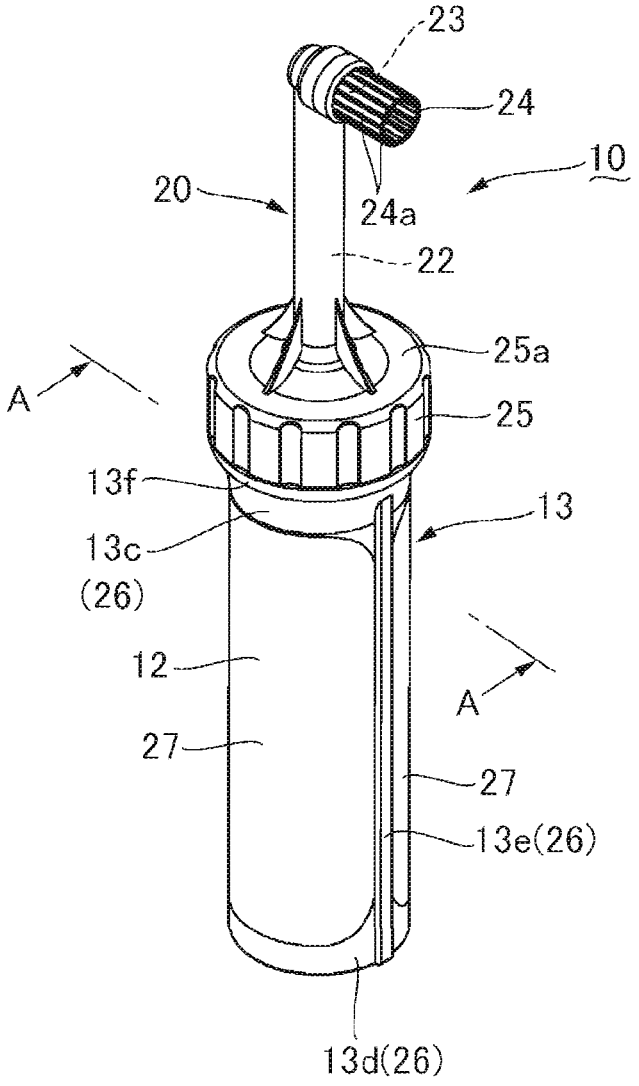
FIG. 1 is a perspective view of a squeeze container (double squeeze container) according to a preferred embodiment of the invention.

In conventional squeeze containers, the container body has a member or a shape for guiding and/or regulating the sections to be pressed at the time of squeezing the press-deforming portions. Thus, guidance is possible so that squeezing is performed, e.g., in the direction along a parting line of the container body formed by blow molding. Unfortunately, conventional squeeze containers do not have means for controlling the squeezing amount with respect to the press-deforming portions. This tends to cause variations in the amount of content discharged depending on the strength of pressing the press-deforming portions, or to cause a waste of content as a result of a more-than-necessary amount of content being discharged.

In the squeeze-type double delamination container of Patent Literature 1, the container body is formed by delaminably layering, by blow molding, an inner layer (inner bag) over the entire region of the inner circumferential surface of a flexible outer layer (outer container). Therefore, when the squeezing operation is released and outside air is introduced between the outer layer and the inner layer while delaminating the two layers, the direction in which the volume-reduced, deformed inner layer delaminates is unstable, and the inner layer may delaminate at a plurality of sections, or may delaminate in an unbalanced manner partially in some regions. This makes it difficult to flatten the inner bag, and a large amount of content tends to remain in the container.

Further, in the double containers of Patent Literatures 1 and 2, the container body and the delamination bottle, which constitute the outer containers, are formed by blow molding, and the inner bag is integrated with the outer container on the parting lines of the outer container. Therefore, this type of inner bag does not allow sufficient outflow of content in sections along the parting lines of the outer container, and a large amount of content tends to remain in the container.

The present invention relates to a squeeze container that is capable of stably discharging a desired amount of content by controlling the squeezing amount when squeezing the press-deforming portions of the container body.

The present invention also relates to a double squeeze container that is capable of reducing the remaining amount of content by allowing the inner bag to flatten easily when squeezing the outer container.

The present invention also relates to an inner bag for double containers that is used by being attached to the inner portion of an outer container and that is capable of reducing the remaining amount of content.

The present invention is a squeeze container that includes a container body including squeezable/deformable press-deforming portions, the squeeze container discharging a content contained in the container body by squeezing of the press-deforming portions. The container body has a tubular body portion including: the press-deforming portions; and longitudinal-direction reinforcing portions molded integrally with the press-deforming portions. The press-deforming portions are made of a different material from the longitudinal-direction reinforcing portions. The longitudinal-direction reinforcing portions are provided as a pair, and extend in a longitudinal direction at respective two locations opposing one another in a radial direction of the tubular body portion. The press-deforming portions are provided as a pair, and arranged in respective sections between the pair of longitudinal-direction reinforcing portions so as to oppose one another.

Figure 2:
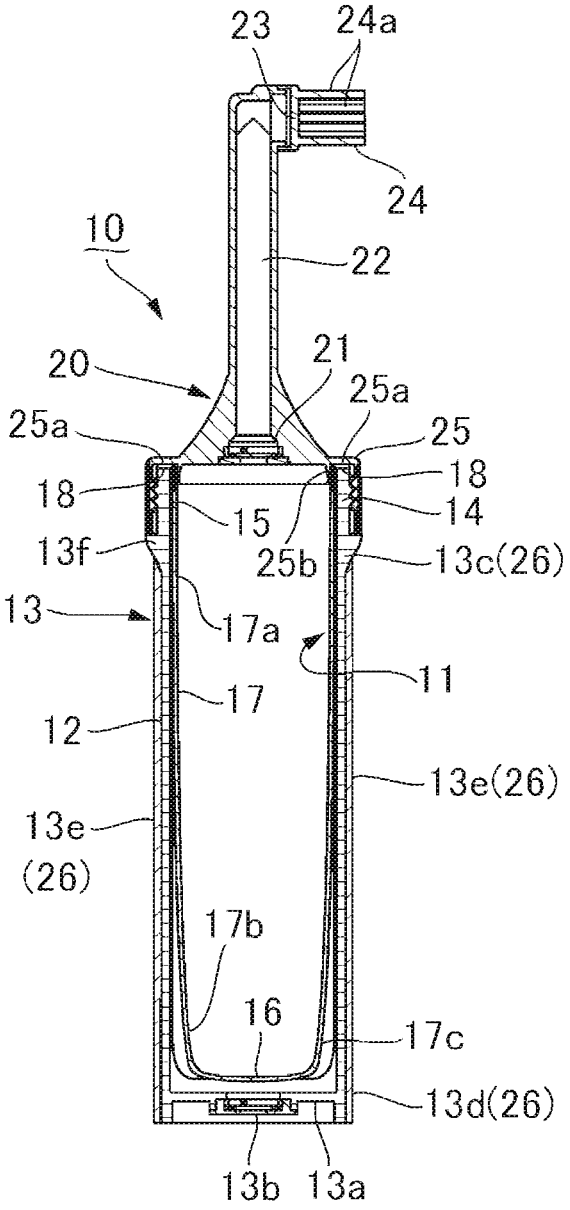
FIG. 2 is a longitudinal sectional view taken along line A-A of FIG. 1.

A squeeze container 10 according to a preferred embodiment of the invention as illustrated in FIGS. 1 and 2 is preferably an applicator-equipped double squeeze container including: an outer container which is a container body 13 including a squeezable/deformable (pressable/deformable) tubular body portion 12 and having a circular-cylindrical bottomed shape (including a substantially circular-cylindrical bottomed shape); an inner bag 11 attached to the inner portion of the outer container 13; and an applicator-equipped cap 20 attached so as to cover a mouth/neck portion (opening) 14 of the outer container 13. The double squeeze container (squeeze container) 10 of the present embodiment is a squeeze container product containing, as its content, a hair treating agent such as a hair dye agent or a styling agent in the container body 13 or the inner bag 11 (the inner bag 11 in the present embodiment), and is used to apply the hair treating agent to the hair. By gripping the tubular body portion 12 of the double squeeze container 10 with the hand and squeezing (pressing) the tubular body portion, the inner bag 11 is reduced in volume and is deformed, and the hair treating agent contained in the inner bag 11 is pressed out to a liquid guide path 22 of the applicator-equipped cap 20 via the check valve 21, and is supplied to a discharge opening 23. After the hair treating agent pressed out to the liquid guide path 22 is discharged from the discharge opening 23, the hair treating agent is held on the inner side of a comb section 24 constituted by a plurality of comb teeth 24*a* arranged annularly so as to surround the periphery of the discharge opening 23. The comb section 24 functions as an application section, and the hair treating agent held on the inner side of the comb section 24 is applied to the hair while combing the hair with the comb section 24.

In the double squeeze container 10, when the squeezing operation of the tubular body portion 12 is finished and the pressed state is released, the check valve 21 of the applicator-equipped cap 20 closes, thereby preventing backflow of the hair treating agent to the inner bag 11 and also maintaining the deformed state of the inner bag 11. On the other hand, the outer container 13 attempts to return to its original shape, and the outer container's inner portion takes on a negative pressure. This negative pressure causes air to flow into a space between the outer container 13 and the volume-reduced, deformed inner bag 11 via, e.g., an air suction valve 13*b* (cf. FIG. 2) provided in a bottom portion 13*a* of the outer container 13. Thus, the outer container 13 returns smoothly to its original shape.

Thereafter, by repeating the squeezing operation of pressing the tubular body portion 12 of the outer container 13 of the double squeeze container 10 and the operation of releasing the squeezed state (pressed state), the hair treating agent—which is the content contained in the inner bag 11—is sequentially pressed out to the discharge opening 23 and is applied to the hair while combing the hair with the comb section 24. The double squeeze container 10 of the present embodiment has the function of stabilizing the discharged amount of content by controlling the squeezing amount when squeezing the outer container 13's tubular body portion 12. Also, the double squeeze container 10 of the present embodiment has a structure that allows the inner bag 11—which is attached to the inner portion of the outer container 13—to be flattened easily, and thus has the function of letting the content flow out efficiently from the inner bag 11 until the final stage of the repeatedly-performed squeezing operation of the body portion 12, and further reducing the amount of content that remains inside the inner bag 11 without completely flowing out (cf. FIGS. 4(*a*) and 4(*b*)). Further, in the present embodiment, the inner bag 11 has a structure that is easily flattened, and thus has the function of letting the content flow out efficiently from the inner bag 11 until the final stage of the repeatedly-performed squeezing operation of the tubular body portion 12, and further reducing the amount of content that remains inside the inner bag 11 without completely flowing out (cf. FIG. 3).

As illustrated in FIGS. 1 and 2, the double squeeze container (squeeze container) 10 of the present embodiment is a squeeze container that includes a container body (outer container) 13 including squeezable/deformable press-deforming portions 27, and that discharges a content contained in an inner bag 11 inside the container body 13 by squeezing (pressing) the press-deforming portions 27. The container body 13 has a tubular body portion 12 including the press-deforming portions 27 and longitudinal-direction reinforcing portions 13*e* molded integrally with the press-deforming portions 27. The press-deforming portions 27 are made of a different material from the longitudinal-direction reinforcing portions 13*e*. A pair of longitudinal-direction reinforcing portions 13*e* is provided, the longitudinal-direction reinforcing portions being provided as a portion of later-described non-pressed portions 26 having an increased thickness, and extending in a longitudinal direction at respective two locations opposing one another in a radial direction of the tubular body portion 12. A pair of press-deforming portions 27 is provided, the press-deforming portions being arranged in respective sections between the pair of longitudinal-direction reinforcing portions 13*e* so as to oppose one another. Preferably, the pair of press-deforming portions 27 each have an arcuate cross-sectional shape (a semicircular arcuate shape in the present embodiment), and, together with the pair of longitudinal-direction reinforcing portions 13*e*, form the overall circular or elliptic (circular in the present embodiment) hollow cross-sectional shape of the outer container 13.

More specifically, in the present embodiment, the container body 13 forms an outer container 13 of a double squeeze container 10 including: the outer container that includes the squeezable/deformable press-deforming portions 27; and a flexible inner bag 11 that is attached to an inner portion of the outer container as a separate member, and that lets a content flow out while being reduced in volume and deformed.

Figure 3:
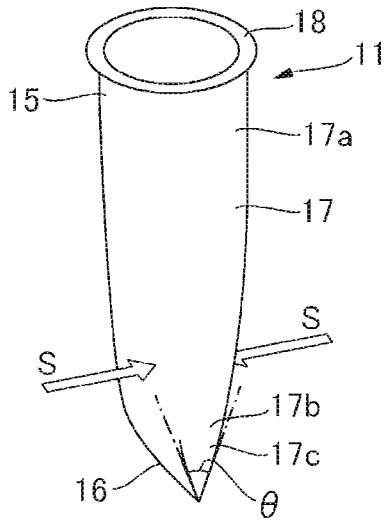
FIG. 3 is a perspective view of an inner bag attached to an inner portion of an outer container.

Further, in the present embodiment, as illustrated in FIGS. 1 to 3, the double squeeze container 10 is a squeeze container including: an outer container 13 that includes squeezable/deformable press-deforming portions 27; and a flexible inner bag 11 that is attached to an inner portion of the outer container 13 as a separate member, and that lets a content flow out while being reduced in volume and deformed. The inner bag 11 includes a flat tubular portion (a portion having a laterally-long cross-sectional shape) 17*b* having a major-axis direction and a minor-axis direction. The outer container 13 is provided with a squeezing-direction guiding means 30 that guides the direction in which the press-deforming portions 27 are squeezed. The inner bag 11 is attached to the inner portion of the outer container 13 by being positioned such that the squeezing direction X (cf. FIG. 4(*a*)) guided by the squeezing-direction guiding means 30 matches the minor-axis direction S of the flat tubular portion 17*b*. The inner bag 11 is guided so as to be flattened in the minor-axis direction S (cf. FIG. 3 and FIG. 4(*b*)) of the flat tubular portion 17*b* by receiving pressing force from the outer container 13.

Further, in the present embodiment, the outer container 13 has a body portion 12 having a circular-cylindrical shape (including a substantially circular-cylindrical shape). A pair of non-pressed portions 26 constituted by the longitudinal-direction reinforcing portions (rib-form longitudinal-direction reinforcing portions in the present embodiment) 13*e* are provided at respective two locations opposing one another in the diameter direction of the circular-cylindrical body portion 12. The longitudinal-direction reinforcing portion 13*e* has an increased thickness. The pair of press-deforming portions 27 each having a semicircular cross-sectional shape (including a substantially semicircular shape) are arranged in respective sections between the pair of longitudinal-direction reinforcing portions 13*e* so as to oppose one another. The pair of press-deforming portions 27, together with the pair of longitudinal-direction reinforcing portions 13*e*, form the overall circular (including substantially circular) cross-sectional shape of the container. In the present embodiment, the non-pressed portions 26 and the press-deforming portions 27 function as the squeezing-direction guiding means 30. Thanks to the outer shape/appearance of the non-pressed portions 26 and the press-deforming portions 27, a user can be guided to place his/her finger on the apex of the semicircular cross-sectional shape of each of the pair of left and right press-deforming portions 27, and to squeeze the press-deforming portions 27 in the squeezing direction X in which the press-deforming portions 27 approach one another.

In the present embodiment, the squeeze container 10 's outer container 13, which is squeezed and has the aforementioned inner bag 11 attached to the inner portion thereof, is preferably a 2-component-injection-molded product made by injection molding using a mold, as illustrated in FIGS. 1 and 2. The outer container 13 includes the non-pressed portions 26 and the pair of press-deforming portions 27. The non-pressed portions 26 are constituted by: an upper end portion 13*c* having a mouth/neck portion 14; a lower end portion 13*d* having a bottom portion 13*a* provided with an air suction valve 13*b*; and the longitudinal-direction reinforcing portions 13*e* (rib-form longitudinal-direction reinforcing portions in the present embodiment) that connect the upper end portion 13*c* and the lower end portion 13*d* in the longitudinal direction, and that are provided at respective two locations opposing one another in the diameter direction of the body portion 12 having a circular-cylindrical shape (including a substantially circular-cylindrical shape). The press-deforming portions 27 are each arranged in a region surrounded by the non-pressed portions 26—which consist of the upper end portion 13*c*, the lower end portion 13*d*, and the longitudinal-direction reinforcing portions 13*e*—and are arranged on both sides sandwiching each longitudinal-direction reinforcing portion 13*e* so as to oppose one another, and each press-deforming portion preferably has a semicircular cross-sectional shape (including a substantially semicircular shape). Thus, the outer container 13 is provided with a circular cross-sectional shape (including a substantially circular shape) as a whole. The press-deforming portion 27 has a considerable length with respect to the length of the body portion 12 of the outer container 13; thus, the press-deforming portions 27 can be pressed and deformed by being squeezed efficiently.

In the present Description, the "longitudinal direction" refers to a direction parallel, or substantially parallel, to the central axis direction of the tubular body portion.

In the present embodiment, the inner bag 11 is an inner bag for a double container, the inner bag fainting a double squeeze container 10 by being attached to the inner portion of the outer container 13. The inner bag 11 lets its content flow out while being reduced in volume and deformed. As illustrated in FIG. 3, the inner bag 11 includes: a circular mouth portion 15 having an outer diameter of a size conforming to an inner circumferential surface of a mouth/neck portion of the outer container 13; a flexible deforming body portion 17 that is continuous with the circular mouth portion 15; and a bottom portion 16 which is closed via the deforming body portion 17. The deforming body portion 17 includes: a circular-cylindrical portion 17*a* which includes the circular mouth portion 15; and a flat tubular portion 17*b* that gradually becomes flat toward the bottom portion 16 in a region including the bottom portion 16. The flat tubular portion 17*b* has a shape in which the cross-sectional area of the deforming body portion 17 is reduced, preferably continuously, toward the bottom portion 16. The inner bag 11 is attached to the inner portion of the outer container 13 in a suspended state by engaging the circular mouth portion 15 to the mouth/neck portion 14. As regards the length of the major axis and the length of the minor axis in the cross section of the flat tubular portion 17*b* of the deforming body portion 17, the flat tubular portion 17*b* has a shape in which at least the length of the minor axis is reduced, preferably continuously, toward the bottom portion 16.

Further, the inner bag 11 is formed by including: a circular mouth portion 15 having an outer diameter that is the same, or substantially the same, as the inner diameter of the mouth/neck portion 14 of the outer container 13; a bottom portion 16 that is preferably rectilinear and has a length that is the same as, or shorter than, the outer diameter of the circular mouth portion 15; and a flexible deforming body portion 17 in a section between the rectilinear bottom portion 16 and the circular mouth portion 15. The deforming body portion 17 has a shape in which its cross-sectional shape changes smoothly, preferably continuously, toward the bottom portion 16 from the circular-cylindrical portion 17*a*, which is continuous with the circular mouth portion 15 on the lower side thereof, via the flat tubular portion (portion having a laterally-long cross-sectional shape) 17*b*, which is continuous with the rectilinear bottom portion 16 on the upper side thereof and whose major-axis direction matches the extending direction of the rectilinear bottom portion 16. Stated differently, the deforming body portion 17 includes a flat tubular portion 17*b* whose cross-sectional shape changes, preferably continuously, toward the rectilinear bottom portion 16 from the circular-cylindrical portion 17*a*, which is continuous with the circular mouth portion 15 on the lower side thereof, and the deforming body portion 17 has a shape in which the major-axis direction of the flat tubular portion 17*b* matches the extending direction of the rectilinear bottom portion 16. The inner bag 11 is attached to the inner portion of the outer container 13 in a suspended state by engaging the circular mouth portion 15 to the mouth/neck portion 14 of the outer container 13.

In the present embodiment, as illustrated in FIGS. 1 and 2, the outer container 13 constituting the double squeeze container 10 is preferably a 2-component-injection-molded product in which the non-pressed portions 26—which hardly deform even when pressed from outside—and the press-deforming portions 27—which elastically deform by a squeezing operation (pressing operation) and which is restorable—are integrally molded by injection molding using a mold. The outer container 13 is, as a whole, formed in anon-constricted, bottomed, circular-cylindrical shape (including a substantially circular-cylindrical shape) having, for example, an inner diameter of about 30 to 50 mm and a height of about 100 to 200 mm, for example. The hollow inner portion of the outer container 13 has a circular cross-sectional shape having the same inner diameter from the upper end opening to the bottom portion 13*a*. An annular jaw portion 13*f* is provided so as to project outward from the outer circumferential surface in the upper end portion of the outer container 13. The section above the annular jaw portion 13*f* constitutes the mouth/neck portion 14 of the outer container 13. A male thread formed on an inner circumferential part of an attachment skirt portion 25 is screwed onto a male thread formed on the outer circumferential part of the mouth/neck portion 14, and thereby, the applicator-equipped cap 20 is integrally fixed to the outer container 13 in a detachable manner.

The non-pressed portions 26 of the outer container 13 include: an upper end portion 13*c* having the mouth/neck portion 14 and the annular jaw portion 13*f*; a lower end portion 13*d* having the bottom portion 13*a* provided with an air suction valve 13*b*; and a pair of longitudinal-rib-form longitudinal-direction reinforcing portions 13*e* provided at respective two locations opposing one another in the diameter direction of the circular-cylindrical body portion 12, and connecting the upper end portion 13*c* and the lower end portion 13*d* in the longitudinal direction. The non-pressed portions 26 constitute a framework part that retains the shape of the outer container 13.

The press-deforming portions 27 of the outer container 13 are provided as a pair, each being arranged in a region, in the circular-cylindrical tubular body portion 12, surrounded by the non-pressed portions 26—which consist of the upper end portion 13*c*, the lower end portion 13*d*, and the longitudinal-direction reinforcing portions 13*e*—and arranged on both sides sandwiching each longitudinal-direction reinforcing portion 13*e* so as to oppose one another. The pair of press-deforming portions 27 each have a semicircular cross-sectional shape (including a substantially semicircular shape), so as to form the overall circular (including substantially circular) cross-sectional shape of the outer container 13. The press-deforming portion 27 has a considerable length with respect to the length of the tubular body portion 12 of the outer container 13 which is the container body; thus, the press-deforming portions 27 can be pressed and deformed by being squeezed efficiently.

Figure 4A:
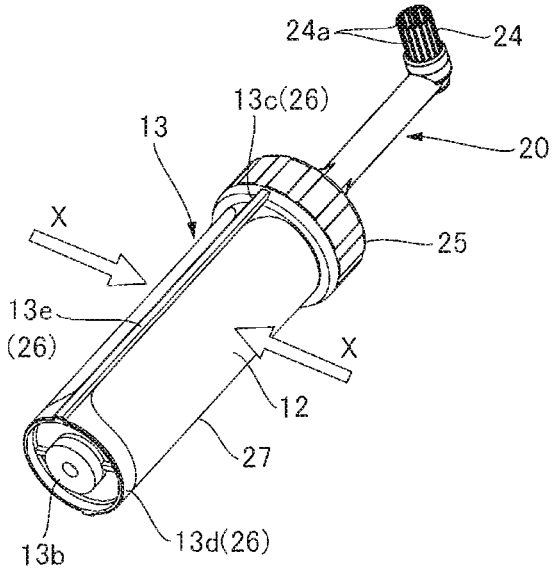
FIG. 4(*a*) is a perspective view illustrating a configuration of a double squeeze container according to a preferred embodiment of the invention.
Figure 4B:
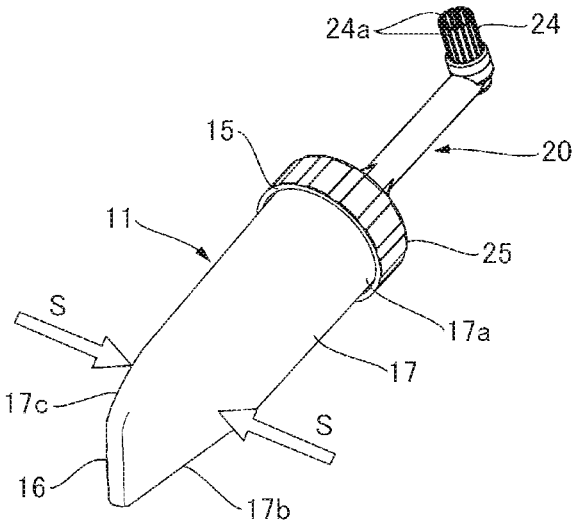

The non-pressed portions 26 and the press-deforming portions 27 function as a squeezing-direction guiding means because: the tubular body portion 12 cannot be deformed when the non-pressed portions 26 are pressed; and also, a user feels that squeezing can be performed most easily by pressing the pair of press-deforming portions 27 by pinching, e.g. with his/her fingers, the apexes of the respective press-deforming portions 27 which bulge out in a semicircular form. Thus, as illustrated in FIG. 4(*a*), a user can be guided to place his/her finger on the apex of each of the pair of left and right press-deforming portions 27, and to squeeze the press-deforming portions 27 in the squeezing direction X in which the press-deforming portions 27 approach one another.

In the present embodiment, the upper end portion 13*c*, the lower end portion 13*d*, and the pair of longitudinal-direction reinforcing portions 13*e*, which constitute the non-pressed portions 26, are formed by using a hard resin, such as polypropylene, high-density polyethylene, or polyacetal. The pair of press-deforming portions 27 each having a semicircular cross-sectional shape are formed by using a flexible soft resin, such as an elastomer or silicone rubber having elasticity. Alternatively, by forming the non-pressed portions 26 thick and forming the press-deforming portions 27 thin, only the press-deforming portions 27 can be formed so as to be elastically deformable.

From the viewpoint of ensuring shape retainability, the flexural modulus of the non-pressed portions 26, which are made of a hard resin such as polypropylene or high-density polyethylene, is preferably from 500 to 2000 MPa, more preferably from 800 to 2000 MPa. The flexural modulus is a value measured according to JIS K7171 (1994).

From the viewpoint of ensuring flexibility, the durometer hardness defined by JIS K6253 of the press-deforming portions 27, which are made of a soft resin such as an elastomer or silicone rubber, is preferably from 0 to 20, more preferably from 0 to 10. Also from the viewpoint of ensuring flexibility, the flexural modulus of the press-deforming portions 27, which are made of a soft resin such as an elastomer or silicone rubber, is preferably from 1 to 200 MPa, more preferably from 1 to 100 MPa. The flexural modulus is a value measured according to JIS K7203 (1995).

In the present embodiment, the inner bag 11 (cf. FIGS. 2 and 3) constituting the double squeeze container 10 can be formed, preferably by injection molding using a mold, by selecting a resin of a grade that is soft and moldable from among synthetic resins such as polyethylene and polypropylene.

At the time of injection molding, the inner bag 11 may be formed by integrally molding, by 2 component injection molding: the circular mouth portion 15 with a hard resin having shape retainability, such as polyethylene, polypropylene, or polyacetal; and the deforming body portion 17 and the bottom portion 16 with a soft resin having flexibility, such as an elastomer (e.g. a styrene-based, polyester-based, olefin-based, or urethane-based elastomer) or silicone rubber. In cases of forming the inner bag 11 by 2 component injection molding, an elastomer may be selected as the soft resin. Herein, "2 component injection molding" refers to an integrally-molding technique using different materials in combination.

From the viewpoint of ensuring flexibility, the durometer hardness defined by JIS K6253 of the deforming body portion 17 and the bottom portion 16, which are made of e.g. an elastomer or silicone rubber, is preferably from 0 to 20, more preferably from 0 to 10. This range of durometer hardness is a type A hardness (momentary value). The durometer hardness is measured according to JIS K6253. Also from the viewpoint of ensuring flexibility, the flexural modulus of the deforming body portion 17 and the bottom portion 16, which are made of e.g. an elastomer or silicone rubber, is preferably from 1 to 200 MPa, more preferably from 1 to 100 MPa. The flexural modulus is a value measured according to JIS K7203 (1995).

Preferably from the viewpoint of ensuring shape retainability, the flexural modulus of the circular mouth portion 15, which is made of e.g. polypropylene, high-density polyethylene, or polyacetal, is preferably from 500 to 2000 MPa, more preferably from 800 to 2000 MPa. The flexural modulus is a value measured according to JIS K7171 (1994).

In the present embodiment, the circular mouth portion 15 of the inner bag 11 is formed such that its outer diameter—which is the same, or substantially the same, as the inner diameter of the mouth/neck portion 14 of the outer container 13—is, for example, from about 28 to 48 mm. By providing the circular mouth portion 15 with an outer diameter that is the same, or substantially the same, as the inner diameter of the mouth/neck portion 14 of the outer container 13, the inner bag 11 can be attached to the inner portion of the outer container 13 by being suspended in a stable state from the mouth/neck portion 14 without shifting sideways. It is preferable that the circular mouth portion 15 is formed so as to have shape retainability. By providing shape retainability to the circular mouth portion 15, the inner bag 11 can be suspended in the inner portion of the outer container 13 by being engaged more stably to the mouth/neck portion 14. Preferably, the circular mouth portion 15 is formed so as to have a thickness of, for example, from about 0.5 to 2 mm.

In the present embodiment, the bottom portion 16 of the inner bag 11 is formed such that its length—which is the same as, or shorter than, the outer diameter of the circular mouth portion 15—is, for example, from about 28 to 48 mm. By providing the bottom portion 16 with a length that is the same as, or shorter than, the outer diameter of the circular mouth portion 15, the mold can be removed smoothly at the time of forming the inner bag 11 preferably by injection molding. Also, even in cases where the outer container 13 is formed in a bottomed circular-cylindrical shape having the same inner diameter from the mouth/neck portion 14 to the bottom portion 13*a* (cf. FIG. 2), the inner bag 11 can be inserted smoothly into the outer container 13 from above until the bottom portion 16 is arranged in the vicinity of the bottom portion 13*a* of the outer container 13.

Preferably, the bottom portion 16 is connected such that the respective lower end portions of a pair of side surfaces that oppose one another in the short width direction in the flat tubular portion 17*b*, which is continuous with the bottom portion 16 on the upper side thereof, intersect with one another at an intersecting angle θ (cf. FIG. 3) of preferably from about 20 to 90 degrees, more preferably from about 45 to 90 degrees, even more preferably from about 60 to 90 degrees, at the bottom portion 16. Stated differently, it is preferable that, in the flat tubular portion 17*b*, a longitudinal-direction sectional shape at the lower end portion of the pair of side surfaces that oppose one another in the short width direction has a V-shape (including a substantially V-shape) in a sectional view. By making the respective lower end portions of the pair of side surfaces that oppose one another in the short width direction in the flat tubular portion 17*b* intersect with one another at an intersecting angle θ of from about 20 to 90 degrees at the bottom portion 16, as the content is made to flow out from the inner portion of the inner bag 11 by the squeezing operation of the squeeze container 10's body portion 12, the inner bag 11 can be flattened and squeezed sequentially and smoothly toward above from the flat tubular portion 17*b*'s lower end portion near the bottom portion 16, while creating a ridgeline (fold line) at each end portion in the major-axis direction of the flat tubular portion 17*b*.

The smaller the radius of curvature of the bottom portion 16 as viewed from the short width direction of the flat tubular portion 17*b* is, the more preferable; however, the bottom portion 16 may have a certain amount of curvature radius. For example, it is preferable that the radius of curvature is from 100 mm to 200 mm. In this range, the inner bag 11 can be flattened and squeezed sequentially and smoothly toward above from the flat tubular portion 17*b*'s lower end portion near the bottom portion 16.

In cases where the thickness of the bottom portion 16 is not thicker than that of the flat tubular portion 17*b*, the inner bag 11 can be sequentially flattened and squeezed more smoothly toward above from the flat tubular portion 17*b*'s lower end portion near the bottom portion 16.

In the present embodiment, the deforming body portion 17 of the inner bag 11 has a shape in which its cross-sectional shape changes smoothly, preferably continuously, toward the bottom portion 16 from the circular-cylindrical portion 17*a*, which is continuous with the circular mouth portion 15 on the lower side thereof, via the flat tubular portion 17*b*, which is continuous with the bottom portion 16 on the upper side thereof. Stated differently, the deforming body portion 17 has a shape that changes, for example, from the circular hollow cross-sectional shape of the circular-cylindrical portion 17*a* to an elliptic (including a substantially elliptic) hollow cross-sectional shape in which the length in the minor-axis direction gradually decreases toward below, and further changes to an oval (including a substantially oval) hollow cross-sectional shape in which the length in the minor-axis direction is gradually decreased even further, and thereafter, the side surfaces on both sides are superposed on one another while reducing the radius of curvature at both end portions of the oval hollow cross-sectional shape, to eventually close the lower end opening at the rectilinear bottom portion 16. Thus, the deforming body portion 17 has a shape in which the outer circumferential surface bulges while gently curving outward. By providing the deforming body portion 17 with such a shape, as the content is made to flow out from the inner portion of the inner bag 11 by the squeezing operation of the double squeeze container 10's body portion 12, the inner bag 11 can be flattened and squeezed sequentially and smoothly toward above from the flat tubular portion 17*b*'s lower end portion near the bottom portion 16, while creating a ridgeline (fold line) 17*c* at each end portion in the major-axis direction of the flat tubular portion 17*b*.

Further, it is preferable that the deforming body portion 17 is made thin such that the section between the bottom portion 16 and the circular mouth portion 15 is provided with flexibility that enables this section to be flattened and squeezed easily. Particularly, it is preferable to form the deforming body portion 17 with a thickness of, for example, from about 300 to 2000 μm. It is preferable that both end portions in the major-axis direction of the portion 17*b* having a laterally-long cross-sectional shape are made thin, so that a ridgeline (fold line) 17*c* can be formed easily at each of these end portions in the major-axis direction. It is preferable to form the bottom portion 16 of the inner bag 11 in a curved shape that projects downward when viewed from a direction perpendicular to the direction in which the bottom portion 16 extends. It is preferable that the corners at both ends of the bottom portion 16 are chamfered into a curved form, and connected respectively with the ridgelines (fold lines) 17*c* formed at the respective end portions in the major-axis direction of the flat tubular portion 17*b*.

In the present embodiment, the inner bag 11 has an annular engagement flange 18 provided so as to project outward from the upper-end edge portion of the circular mouth portion 15. Preferably, the inner bag 11 is attached to the inner portion of the outer container 13 in a suspended state by placing and arranging the annular engagement flange 18 on the upper end surface of the mouth/neck portion 14 of the outer container 13.

More specifically, in the inner bag 11 of the present embodiment, the annular engagement flange 18 is provided by being integrally molded with the circular mouth portion 15 so as to project outward in an annular ring shape with a width of, for example, about 0.5 to 2 mm from the upper-end edge portion of the circular mouth portion 15. As illustrated in FIG. 2, at the time of detachably fixing an attachment skirt portion 25 of the applicator-equipped cap 20 by screwing the attachment skirt portion onto the outer circumferential part of the outer container 13's mouth/neck portion 14, the annular engagement flange 18 is arranged on the upper end surface of the outer container 13's mouth/neck portion 14 and fastened thereon, and simultaneously, the annular engagement flange 18 that has been arranged is sandwiched and fixed between the upper end surface and the peripheral top surface 25*a* of the attachment skirt portion 25. Thus, the inner bag 11 filled with a hair treating agent, which is an example of a content, can be attached to the inner portion of the outer container 13 more stably. Further, by sandwiching and fixing the annular engagement flange 18 between the upper end surface of the outer container 13's mouth/neck portion 14 and the peripheral top surface 25*a* of the applicator-equipped cap 20's attachment skirt portion 25, the inner portion of the inner bag 11 can be sealed firmly, and thus, the hair treating agent contained inside the inner bag 11 can be discharged more smoothly by the squeezing operation of the outer container 13's body portion 12.

It is preferable that, when attaching the inner bag 11 to the inner portion of the outer container 13 in a suspended state, the inner bag 11 is attached to the outer container 13 in a state where the direction in which the inner bag 11's bottom portion 16 extends is along the diameter direction in which the pair of the longitudinal-direction reinforcing portions 13*e* are arranged in opposition to one another. In this way, the direction in which the squeeze container 10 is squeezed (pressed) such that the pair of press-deforming portions 27 of the outer container 13 are pinched from both sides matches the direction in which the inner bag 11 is flattened and squeezed from the bottom portion 16 toward above. Thus, the content can be caused to flow out from the inner bag 11 while efficiently flattening the inner bag 11.

Further, in the present embodiment, an inner ring 25*b* projecting downward in a ring shape is provided from a radially inner section of the peripheral top surface 25*a* of the applicator-equipped cap 20's attachment skirt portion 25. The inner ring 25*b* has an outer diameter that matches the inner diameter of the outer container 13's mouth/neck portion 14 onto which the attachment skirt portion 25 is screwed. When fixing the applicator-equipped cap 20 by screwing the attachment skirt portion 25 onto the outer container 13's mouth/neck portion 14, the inner ring 25*b* comes into tight contact with the inner circumferential surface of the circular mouth portion 15 of the inner bag 11—which is suspended in the inner portion of the outer container 13 by arranging the annular engagement flange 18 on the upper end surface of the mouth/neck portion 14—and can also press the circular mouth portion 15 toward the inner circumferential surface of the mouth/neck portion 14. Thus, the inner portion of the inner bag 11 can be sealed more firmly.

It should be noted that it is not absolutely necessary to provide an annular engagement flange that projects outward from the upper-end edge portion of the inner bag 11. In cases where there is no annular engagement flange, the inner bag 11 may be attached to the inner portion of the outer container 13 in a suspended state by, for example, bonding and fastening the circular mouth portion 15 to the inner surface of the outer container 13's mouth/neck portion 14. Further, FIG. 2 is illustrated such that there is no clearance between the outer circumferential surface of the deforming body portion 17 and the inner circumferential surface of the outer container 13's body portion 12, particularly in the upper half of the inner bag 11's deforming body portion 17. However, it is preferable to provide a clearance of, for example, about 1 to 2 mm therebetween. This allows the inner bag 11 to be flattened more smoothly.

As illustrated in FIGS. 4(*a*) and 4(*b*), in the double squeeze container 10 of the present embodiment, the inner bag 11 is attached to the inner portion of the outer container 13 by being positioned such that the squeezing direction X guided by the squeezing-direction guiding means 30 of the outer container 13 matches the minor-axis direction S of the flat tubular portion 17*b* of the inner bag 11. Stated differently, the inner bag 11 is attached to the inner portion of the outer container 13 by being positioned such that the extending direction of the bottom portion 16 is along the diameter direction in which the outer container 13's pair of longitudinal-direction reinforcing portions 13*e*—which are the non-pressed portions 26—oppose one another. As for means for positioning the inner bag 11 such that the extending direction of the inner bag 11's bottom portion 16 is along the diameter direction in which the outer container 13's pair of longitudinal-direction reinforcing portions 13*e* oppose one another, it is possible to use various known engagement means, such as a male/female lock mechanism or a screw stopper mechanism provided to the outer container 13's mouth/neck portion 14, the inner bag 11's circular mouth portion 15, and/or the peripheral top surface 25*a* of the applicator-equipped cap 20's attachment skirt portion 25.

As described above, in the double squeeze container 10 of the present embodiment, by gripping the tubular body portion 12 with the hand and squeezing the tubular body portion, the inner bag 11 is reduced in volume and is deformed, and its content—i.e., a hair treating agent—contained in the inner bag 11 is pressed out to the liquid guide path 22 of the applicator-equipped cap 20 and is discharged from the discharge opening 23. The discharged hair treating agent is held on the inner side of the comb section 24 constituted by the plurality of comb teeth 24*a*, and is applied in this state to the hair while combing the hair with the comb section 24. According to the double squeeze container 10 of the present embodiment, it is possible to stably discharge a desired amount of hair treating agent by controlling the squeezing amount when squeezing the press-deforming portions 27 of the outer container 13.

More specifically, according to the present embodiment, the outer container 13 has a tubular body portion 12 including: press-deforming portions 27; and longitudinal-direction reinforcing portions 13*e* molded integrally with the press-deforming portions 27. A pair of longitudinal-direction reinforcing portions 13*e* is provided, the longitudinal-direction reinforcing portions extending in the longitudinal direction at respective two locations opposing one another in the radial direction of the tubular body portion 12. A pair of press-deforming portions 27 is provided, wherein the press-deforming portions are preferably arranged in respective sections between the pair of longitudinal-direction reinforcing portions 13*e* so as to oppose one another, and each preferably have a semicircular arcuate cross-sectional shape, so as to form the overall circular hollow cross-sectional shape of the outer container 13. Thus, when a user grips the tubular body portion 12 and squeezes the pair of press-deforming portions 27 in the squeezing direction X by pinching the apexes of the respective press-deforming portions 27 which bulge out in a semicircular form, the longitudinal-direction reinforcing portions 13*e*—which are arranged on both sides of each of the pair of press-deforming portions 27 while being sandwiched therebetween—do not deform; thus, the squeezing amount is regulated. Also, even when a user performs a squeezing operation by applying excessive pressing force, the squeezing amount of the press-deforming portions 27 is restricted because the longitudinal-direction reinforcing portions 13*e* do not deform.

Accordingly, with the double squeeze container 10 of the present embodiment, it is possible to control the squeezing amount when the outer container 13's press-deforming portions 27 are squeezed. Also, a constant squeezing amount can be maintained by allowing a user to perform a squeezing operation up to a point where the squeezing amount of the press-deforming portions 27 is restricted by the longitudinal-direction reinforcing portions 13*e*. Thus, a desired amount of hair treating agent can be discharged stably.

Further, according to the present embodiment, the inner bag 11 includes a flat tubular portion 17*b* having a major-axis direction and a minor-axis direction, and thus, the inner bag 11 is guided so as to be flattened in the minor-axis direction S of the flat tubular portion 17*b* by receiving pressing force from the outer container 13. Further, in the outer container 13, the squeezing direction X of the press-deforming portions 27 is guided by the squeezing-direction guiding means 30, and the inner bag 11 is attached to the inner portion of the outer container 13 by being positioned such that the squeezing direction X matches the minor-axis direction S of the flat tubular portion 17*b* of the inner bag 11. Thus, when the double squeeze container 10 is squeezed, the pressing force applied when squeezing the outer container 13's press-deforming portions 27 in the squeezing direction X is transferred efficiently in the direction in which the inner bag 11 is flattened. Thus, for example, as the content is made to flow out from the inner portion of the inner bag 11, the inner bag 11 can be flattened and squeezed sequentially and smoothly toward above from the flat tubular portion 17*b*'s lower end portion near the bottom portion 16, while creating a ridgeline (fold line) 17*c* at each end portion in the major-axis direction of the flat tubular portion 17*b*. The aforementioned configuration also minimizes the remaining amount of content particularly in the inner-side sections of the respective ridgelines (fold lines) 17*c* sequentially created from the bottom portion 16 toward above when the inner bag 11 is flattened, thus allowing the remaining amount of content to be reduced.

Further, according to the double squeeze container 10 of the present embodiment, the comb section 24—which retains the hair treating agent that has flowed out from the inner bag 11 and has been discharged from the discharge opening 23, and applies the hair treating agent to the hair while combing the hair—is provided so as to face the direction along the diameter direction in which the pair of longitudinal-direction reinforcing portions 13*e* of the outer container 13 oppose one another. Thus, it is possible to easily and smoothly perform the operation of gripping the outer container 13's tubular body portion 12 with the hand and combing the hair with the comb section 24 while squeezing the press-deforming portions 27 in the squeezing direction X, even with respect to, e.g., hair in the back of the head.

Furthermore, according to the present embodiment, the inner bag 11 includes: a circular mouth portion 15; a bottom portion 16 that is preferably rectilinear; and a flexible deforming body portion 17 between the bottom portion 16 and the circular mouth portion 15. The deforming body portion 17 has a shape in which its cross-sectional shape changes smoothly, preferably continuously, toward the bottom portion 16 from the circular-cylindrical portion 17*a*, which is continuous with the circular mouth portion 15 on the lower side thereof, via the flat tubular portion 17*b*, which is continuous with the bottom portion 16 on the upper side thereof. The inner bag 11 is attached to the inner portion of the outer container 13 in a suspended state. Thus, as the content is made to flow out from the inner portion of the inner bag 11 by the squeezing operation of the squeeze container 10's body portion 12, the inner bag 11 can be flattened and squeezed sequentially and smoothly toward above from the flat tubular portion 17*b*'s lower end portion near the bottom portion 16, while creating a ridgeline (fold line) 17*c* at each end portion in the major-axis direction of the flat tubular portion 17*b*. The aforementioned configuration can also reduce the remaining amount of content, and can also reduce the remaining amount of content particularly in the inner-side sections of the respective ridgelines (fold lines) 17*c* sequentially created from the bottom portion 16 toward above when the inner bag 11 is flattened.

Figure 5:
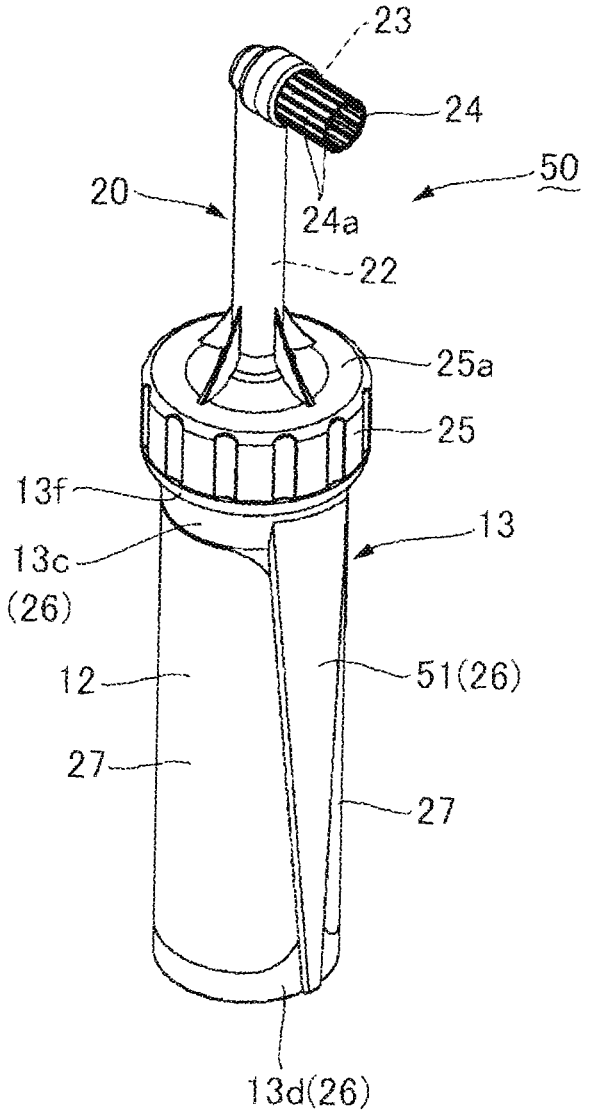
FIG. 5 is a perspective view of a squeeze container according to another preferred embodiment of the invention.

FIG. 5 illustrates a squeeze container 50 according to another preferred embodiment of the invention. The squeeze container 50 of this other embodiment is a double squeeze container having a structure similar to the squeeze container 10 of the embodiment illustrated in FIG. 1. However, in the squeeze container 50 of this other embodiment, unlike the longitudinal-rib-form longitudinal-direction reinforcing portions 13*e* of the foregoing embodiment, the pair of longitudinal-direction reinforcing portions 51—which constitute the non-pressed portions 26 of the outer container 13 and which connect the upper end portion 13*c* and the lower end portion 13*d* in the longitudinal direction—are formed as plate-like reinforcing portions each having an inverted isosceles triangular shape (including a substantially isosceles triangular shape) provided by changing the width thereof along the vertical direction such that the width is narrowed preferably from the upper end portion toward the lower end portion.

Even with this double squeeze container (squeeze container) 50 of this other embodiment, the same effects as those of the squeeze container 10 of the foregoing embodiment can be achieved. Further, according to the double squeeze container 50 of this other embodiment, because the longitudinal-direction reinforcing portions 51 are formed by changing the width thereof along the vertical direction, the squeezing amount regulated by the longitudinal-direction reinforcing portions 51 when the press-deforming portions 27 are squeezed can be varied along the vertical direction, and thus, the amount of content—i.e., hair treating agent—discharged can be adjusted depending on the position, in the vertical direction, where the press-deforming portions 27 are pressed.

Figure 6A:
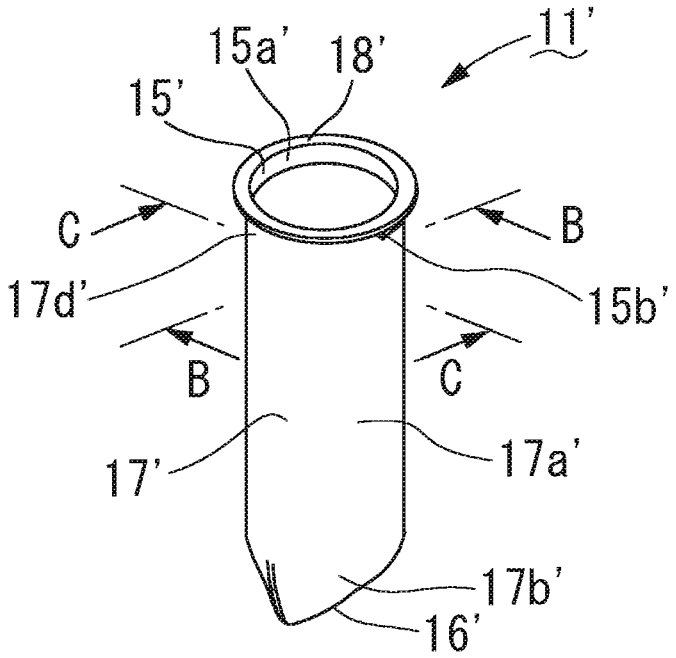
FIG. 6(*a*) is a perspective view illustrating an example of another embodiment of an inner bag.
Figure 6B:
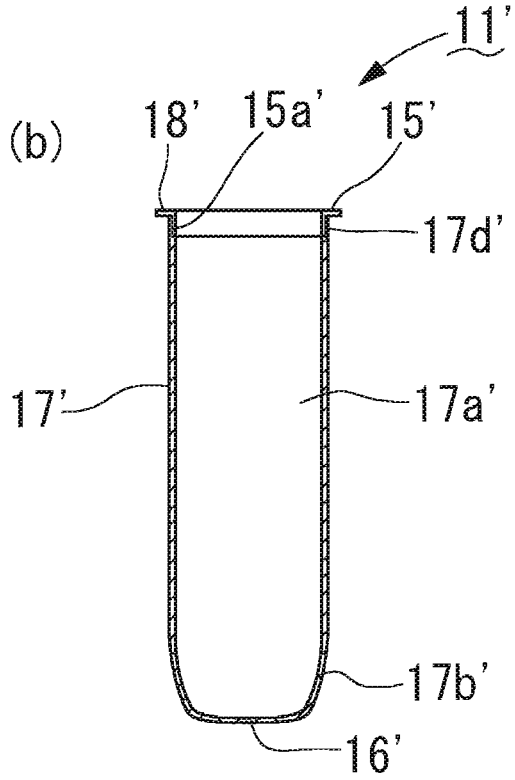
Figure 6C:
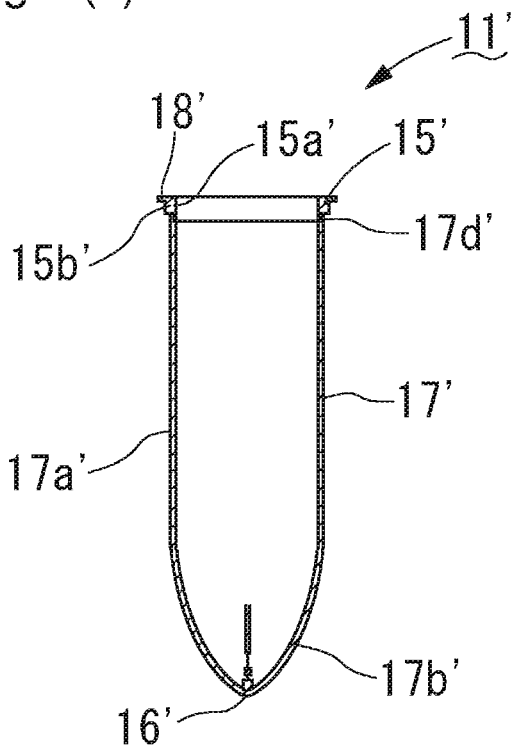

FIGS. 6(*a*) to 6(*c*) illustrate an example of another embodiment of an inner bag 11' constituting the double squeeze container 10 of the foregoing embodiment or the double squeeze container 50 of the aforementioned other embodiment. In the inner bag 11' of FIGS. 6(*a*) to 6(*c*), the inner bag 11' is formed such that: the circular mouth portion 15' made of a hard resin having shape retainability is molded as a separate member from the deforming body portion 17' and the bottom portion 16' made of a soft resin having flexibility; and the circular mouth portion 15' is attached to and integrated with the deforming body portion 17' and the bottom portion 16' by attaching the upper end portion 17*d'* of the deforming body portion 17' so as to cover an outer circumferential surface of the circular mouth portion 15'.

In the inner bag 11' of FIGS. 6(*a*) to 6(*c*), the circular mouth portion 15' is preferably an injection molded product made by using a mold, and is formed by using a hard resin—such as polyethylene, polypropylene, or polyacetal—having shape retainability and having the same physical properties as the resin used for the circular mouth portion 15 of the inner bag 11 illustrated in FIG. 3. The circular mouth portion 15' is formed by including: a flat circular-cylindrical mouth portion body 15*a'* whose height is from about 5 to 10 mm and whose outer diameter is the same, or substantially the same, as the inner diameter of the mouth/neck portion 14 of the outer container 13, and is, for example, from about 28 to 48 mm; and an annular engagement flange 18' provided so as to project outward from the upper-end edge portion of the mouth portion body 15*a'*. Preferably, the circular mouth portion 15' is formed so as to have a thickness of, for example, from about 0.5 to 2 mm.

The circular mouth portion 15' has a pair of engagement projection ribs 15*d'* projecting outward from the outer circumferential surface of the mouth portion body 15*a'* at positions opposing one another in the diameter direction of the mouth portion body 15*a'*. The engagement projection ribs 15*d'* engage with respective positioning/engagement depressions (not illustrated) which are provided in the upper end surface of the outer container 13's mouth/neck portion 14, and thereby, the annular engagement flange 18' can be arranged on the upper end surface of the mouth/neck portion 14. In this way, the inner bag 11' for double containers can be suspended inside the outer container 13 in a state where, for example, the direction in which the bottom portion 16' of the inner bag 11' extends is positioned along the diameter direction in which the pair of the longitudinal-direction reinforcing portions 13*e* of the outer container 13 are arranged in opposition to one another.

The deforming body portion 17' and the bottom portion 16' are each preferably an injection-molded product made by using a mold, and are each formed by using a soft resin—such as an elastomer (e.g. a styrene-based, polyester-based, olefin-based, or urethane-based elastomer) or silicone rubber—having flexibility and having the same physical properties as the resin used for the deforming body portion 17 and the bottom portion 16 of the inner bag 11 illustrated in FIG. 3. As with the deforming body portion 17 of the inner bag 11 illustrated in FIG. 3, the deforming body portion 17' includes: a circular-cylindrical portion 17*a'*; and a flat tubular portion 17*b'* that gradually becomes flat toward the closed bottom portion 16'. The flat tubular portion 17*b'* has a shape in which the cross-sectional area of the deforming body portion 17' is reduced, preferably continuously, toward the bottom portion 16'. As regards the length of the major axis and the length of the minor axis in the cross section of the flat tubular portion 17*b'* of the deforming body portion 17', the flat tubular portion 17*b'* has a shape in which at least the length of the minor axis is reduced, preferably continuously, toward the bottom portion 16'. Further, it is preferable that the deforming body portion 17' is made thin such that the section between the bottom portion 16' and the circular mouth portion 15' is provided with flexibility that enables this section to be flattened and squeezed easily. Particularly, it is preferable to form the deforming body portion 17' with a thickness of, for example, from about 300 to 2000 μm.

In the inner bag 11' of FIGS. 6(*a*) to 6(*c*), the upper end portion 17*d'* of the deforming body portion 17' is firmly attached in a tight-contact state by, e.g., bonding using fusion-bonding or an adhesive so as to cover the entire outer circumferential surface of the mouth portion body 15*a'* of the circular mouth portion 15' in sections except for the engagement projection ribs 15*b'*. Thus, the inner bag 11' is formed such that the circular mouth portion 15' is attached to and integrated with the deforming body portion 17' and the bottom portion 16'.

Also, according to the inner bag 11' of FIGS. 6(*a*) to 6(*c*), the inner bag 11' is used by being attached to the inner portion of the outer container 13 in a suspended state, and, as the content is made to flow out from the inner portion of the inner bag 11' by the squeezing operation of the squeeze container 10's body portion 12, the inner bag 11' can be flattened and squeezed sequentially and smoothly toward above from the lower end portion of the flat tubular portion 17*b'* near the bottom portion 16', while creating a ridgeline (fold line) at each end portion in the major-axis direction of the flat tubular portion 17*b*'. Thus, the same effects as those of the inner bag 11 illustrated in FIG. 3 can be achieved.

Further, according to the inner bag 1 of FIGS. 6(*a*) to 6(*c*), the outer circumferential surface of the mouth portion body 15*a*' of the circular mouth portion 15' made of a hard resin is covered by the upper end portion 17*d*' of the deforming body portion 17' made of a soft resin. Thus, when fixing the applicator-equipped cap 20 onto the outer container 13 by screwing the attachment skirt portion 25 onto the mouth/neck portion 14 of the outer container 13, the upper end portion 17*d*' of the deforming body portion 17' made of a soft resin is interposed and sandwiched between the outer circumferential surface of the mouth portion body 15*a*' of the circular mouth portion 15' and the inner circumferential surface of the mouth/neck portion 14. Thus, when pressing the mouth portion body 15*a*' of the circular mouth portion 15' against the inner circumferential surface of the mouth/neck portion 14 with the inner ring 25*b* (cf. FIG. 2), the mouth portion body 15*a*' can be brought into tight contact with the inner circumferential surface of the mouth/neck portion 14 across the upper end portion 17*d*' of the flexible deforming body portion 17'. Thus, the inner portion of the inner bag 11' can be sealed even more firmly and reliably.

It should be noted that the present invention is not limited to the foregoing embodiments, and various modifications are possible. For example, the squeeze container of the invention does not necessarily have to be a double squeeze container including an outer container as a container body and an inner bag attached to the inner portion of the outer container. Instead, the squeeze container may be a squeeze-type double delamination container in which an inner bag is delaminably layered on the inner side of an outer container. Alternatively, the squeeze container may be a single squeeze container in which a content is contained in the container body without providing an inner bag, and the content is discharged from the container body to a discharge section. Other than injection-molded products, the container body and/or the inner bag may be formed by blow molding or the like. In the container body, the hollow cross section of the mouth/neck portion may be smaller than the hollow cross section of the tubular body portion. The tubular body portion may have an elliptic hollow cross-sectional shape. Other than hair treating agents, the content to be contained may be any of various other types of liquid content, such as cosmetics, cleansing agents, chemical agents, and food products, that can be discharged by squeezing. The outer container does not necessarily have to have a circular-cylindrical body portion, and it may have a different shape, such as an elliptic cross-sectional shape. Other than means achieved by the outer shape/appearance of the outer container, the squeezing-direction guiding means for guiding the squeezing direction of the press-deforming portions may be, for example, means that specifically indicates the squeezing direction of the press-deforming portions by, e.g., applying a mark onto the outer circumferential surface of the outer container.

The bottom portion of the inner bag does not necessarily have to be a rectilinear bottom portion, and the bottom portion may be arcuate (preferably arcuate-linear).

In relation to the foregoing embodiments of the invention, the following additional features (squeeze containers and squeeze container products) are further disclosed.

{1}

A squeeze container comprising a container body including squeezable/deformable press-deforming portions, the squeeze container discharging a content contained in the container body by squeezing of the press-deforming portions, wherein:

the container body has a tubular body portion including the press-deforming portions and longitudinal-direction reinforcing portions molded integrally with the press-deforming portions;

the press-deforming portions are made of a different material from the longitudinal-direction reinforcing portions;

the longitudinal-direction reinforcing portions are provided as a pair, and extend in a longitudinal direction at respective two locations opposing one another in a radial direction of the tubular body portion; and the press-deforming portions are provided as a pair, and arranged in respective sections between the pair of longitudinal-direction reinforcing portions so as to oppose one another.

{2}

A double squeeze container comprising:

an outer container that includes squeezable/deformable press-deforming portions; and a flexible inner bag that is attached to an inner portion of the outer container as a separate member, and that lets a content flow out while being reduced in volume and deformed, wherein:

the outer container is provided with a squeezing-direction guiding means that guides the direction in which the press-deforming portions are squeezed;

the inner bag is attached to the inner portion of the outer container by being positioned such that the squeezing direction guided by the squeezing-direction guiding means matches a minor-axis direction of a flat tubular portion; and because the inner bag includes the flat tubular portion having a major-axis direction and a minor-axis direction, the inner bag is guided so as to be flattened in the minor-axis direction of the flat tubular portion by receiving pressing force from the outer container.

{3}

An inner bag for double containers that is to be attached to an inner portion of an outer container including a mouth/neck portion having a circular cross section, and that lets a content flow out while being reduced in volume and deformed, the inner bag comprising:

a circular mouth portion having an outer diameter of a size conforming to an inner circumferential surface of the mouth/neck portion of the outer container;

a flexible deforming body portion that is continuous with the circular mouth portion; and a bottom portion which is closed via the deforming body portion, wherein:

the deforming body portion includes a circular-cylindrical portion, and a flat tubular portion that gradually becomes flat toward the bottom portion;

the flat tubular portion has a shape in which the cross-sectional area of the deforming body portion is reduced toward the bottom portion; and the inner bag is attached to the inner portion of the outer container in a suspended state by engaging the circular mouth portion to the mouth/neck portion.

{4}

The squeeze container as set forth in clause {1}, wherein the longitudinal-direction reinforcing portion is a longitudinal-rib-form reinforcing portion.

{5}

The squeeze container as set forth in clause {1} or {4}, wherein:

the container body forms an outer container of a double squeeze container including the outer container that includes the squeezable/deformable press-deforming portions, and a flexible inner bag that is attached to an inner portion of the outer container as a separate member, and that lets a content flow out while being reduced in volume and deformed;

the inner bag includes a flat tubular portion having a major-axis direction and a minor-axis direction;

the inner hag is attached to the inner portion of the container body by being positioned such that a squeezing direction in which the container body's press-deforming portions are squeezed matches the minor-axis direction of the flat tubular portion; and the inner bag is guided so as to be flattened in the minor-axis direction of the flat tubular portion by receiving pressing force from the container body.

{6}

The squeeze container as set forth in clause {5}, wherein the inner bag is attached to the inner portion of the container body by being positioned such that a direction in which the inner bag's bottom portion extends is along the radial direction in which the pair of the longitudinal-direction reinforcing portions of the container body oppose one another.

{7}

The squeeze container as set forth in any one of clauses {1} to {6}, wherein the container body has a circular-cylindrical body portion.

{8}

The squeeze container as set forth in clause {7}, wherein:

a pair of non-pressed portions constituted by the longitudinal-direction reinforcing portions are provided at respective two locations opposing one another in the radial direction of the circular-cylindrical body portion of the container body;

the pair of press-deforming portions each have a semi-circular cross-sectional shape, and are arranged in respective sections between the pair of longitudinal-direction reinforcing portions so as to oppose one another; and the non-pressed portions and the press-deforming portions serve as a squeezing-direction guiding means that guides the squeezing direction so that a finger is placed on each of the pair of press-deforming portions and the press-deforming portions are squeezed in a direction in which the press-deforming portions approach one another.

{9}

The squeeze container as set forth in any one of clauses {5} to {8}, wherein:

the inner bag includes a circular mouth portion having an outer diameter of a size conforming to an inner circumferential surface of a mouth/neck portion of the container body, a flexible deforming body portion that is continuous with the circular mouth portion, and the bottom portion which is closed via the deforming body portion;

the deforming body portion includes a circular-cylindrical portion, and the flat tubular portion that gradually becomes flat toward the bottom portion;

the flat tubular portion has a shape in which the cross-sectional area of the deforming body portion is reduced toward the bottom portion; and the inner bag is attached to the inner portion of the outer container in a suspended state by engaging the circular mouth portion to the mouth/neck portion.

{10}

The squeeze container as set forth in clause {9}, wherein the inner bag is attached such that a clearance is kept between the outer circumferential surface of the deforming body portion and the inner circumferential surface of the body portion of the outer container.

{11}

The squeeze container as set forth in clause {9} or {10}, wherein, as regards the length of the major axis and the length of the minor axis in the cross section of the flat tubular portion of the inner bag's deforming body portion, the flat tubular portion has a shape in which at least the length of the minor axis is reduced toward the bottom portion.

{12}

The squeeze container as set forth in any one of clauses {9} to {11}, wherein, in the flat tubular portion of the inner bag's deforming body portion, a longitudinal-direction sectional shape at a lower end portion of a pair of side surfaces that oppose one another in the short width direction has a V-shape in a sectional view.

{13}

The squeeze container as set forth in clause {12}, wherein the bottom portion of the inner bag is connected such that the respective lower end portions of the pair of side surfaces that oppose one another in the short width direction in the flat tubular portion, which is continuous with the bottom portion on an upper side thereof, intersect with one another at an intersecting angle of from 20 to 90 degrees at the bottom portion.

{14}

The squeeze container as set forth in any one of clauses {9} to {13}, wherein the inner bag is formed by integrally molding, by 2 component injection molding:

the circular mouth portion with a hard resin having shape retainability; and the deforming body portion and the bottom portion with a soft resin having flexibility.

{15}

The squeeze container as set forth in any one of clauses {9} to {13}, wherein the inner bag is formed such that:

the circular mouth portion made of a hard resin having shape retainability is molded as a separate member from the deforming body portion and the bottom portion made of a soft resin having flexibility; and the circular mouth portion is attached to and integrated with the deforming body portion and the bottom portion by attaching an upper end portion of the deforming body portion so as to cover an outer circumferential surface of the circular mouth portion.

{16}

The squeeze container as set forth in any one of clauses {9} to {15}, wherein:

an annular engagement flange is provided so as to project outward from an upper-end edge portion of the circular mouth portion; and the inner bag is attached to the inner portion of the outer container in a suspended state by arranging the annular engagement flange on an upper end surface of the mouth/neck portion.

{17}

The squeeze container as set forth in any one of clauses {5} to {16}, wherein:

the inner bag is attached to the inner portion of the container body that includes a mouth/neck portion having a circular cross section; and an applicator-equipped cap having a check valve is attached so as to cover the mouth/neck portion of the container body.

{18}

The squeeze container as set forth in clause {17}, wherein the applicator-equipped cap is provided with a comb section that faces a direction along the radial direction in which the pair of the longitudinal-direction reinforcing portions of the container body oppose one another.

{19}

The squeeze container as set forth in any one of clauses {9} to {18}, wherein the deforming body portion of the inner bag has a shape that changes from a circular hollow cross-sectional shape of the circular-cylindrical portion to an elliptic hollow cross-sectional shape in which the length in the minor-axis direction gradually decreases toward below, and further changes to an oval hollow cross-sectional shape in which the length in the minor-axis direction is gradually decreased even further, and thereafter, the side surfaces on both sides are superposed on one another while reducing the radius of curvature at both end portions of the oval hollow cross-sectional shape, to eventually close the lower end opening at the bottom portion.

{20}

The squeeze container as set forth in any one of clauses {9} to {19}, wherein the bottom portion of the inner bag is a rectilinear or arcuate bottom portion.

{21}

The squeeze container as set forth in any one of clauses {9} to {20}, wherein the corners at both ends of the bottom portion of the inner bag are chamfered into a curved form, and connected respectively with the ridgelines formed at the respective end portions in the major-axis direction of the flat tubular portion.

{22}

The squeeze container as set forth in clause {1}, wherein the longitudinal-direction reinforcing portions are formed by changing the width thereof along the vertical direction.

{23}

The squeeze container as set forth in clause {22}, wherein each longitudinal-direction reinforcing portion is formed as a plate-like reinforcing portion whose width narrows from the upper end portion toward the lower end portion.

{24}

The squeeze container as set forth in any one of clauses {1} to {23}, wherein the container body is a 2-component-injection-molded product integrally molded by injection molding using a mold.

{25}

The squeeze container as set forth in any one of clauses {1} to {24}, wherein the press-deforming portions are formed by using, as a flexible soft resin, a resin selected from elastomers and silicone rubber.

{26}

The squeeze container as set forth in any one of clauses {1} to {25}, wherein the longitudinal-direction reinforcing portions are formed by using, as a hard resin, a resin selected from polypropylene, high-density polyethylene, and polyacetal.

{27}

A squeeze container product, wherein a content is contained in the inner bag of the squeeze container as set forth in any one of clauses {5} to {26}.

INDUSTRIAL APPLICABILITY

According to the squeeze container or the squeeze container product of the invention, it is possible to stably discharge a desired amount of content by controlling the squeezing amount when squeezing the press-deforming portions of the container body.

Further, according to the squeeze container or the squeeze container product of the invention, when a double squeeze container is formed by attaching an inner bag to the inner portion of a container body, it is possible to reduce the remaining amount of content by allowing the inner bag to flatten easily when squeezing the outer container.

Further, according to the squeeze container or the squeeze container product of the invention, when a double squeeze container is formed by attaching an inner bag to the inner portion of a container body, it is possible to reduce the remaining amount of content contained in the inner bag.

The invention claimed is:

1. A squeeze container comprising a container body, the container body comprising squeezable/deformable press-deforming portions, the squeeze container discharging content present in the container body by squeezing of the press-deforming portions, wherein:

the container body has a tubular body portion that comprises the press-deforming portions and longitudinal-direction reinforcing portions molded integrally with the press-deforming portions;

the press-deforming portions are comprised of a different material from the material comprising the longitudinal-direction reinforcing portions;

the longitudinal-direction reinforcing portions are present as a pair, and extend in a longitudinal direction at respective two locations opposing one another in a radial direction of the tubular body portion;

the press-deforming portions are present as a pair, and arranged in respective sections between the pair of longitudinal-direction reinforcing portions so as to oppose one another; and the container body forms an outer container of a double squeeze container that comprises the outer container that comprises the squeezable/deformable press-deforming portions, and a flexible inner bag that is attached to an inner portion of the outer container as a separate member, and that lets a content flow out while being reduced in volume and deformed;

the inner bag comprises a flat tubular portion having a major-axis direction and a minor-axis direction;

the inner bag is attached to the inner portion of the container body by being positioned such that a squeezing direction in which the press-deforming portions of the container body are squeezed matches the minor-axis direction of the flat tubular portion; and the inner bag is guided so as to be flattened in the minor-axis direction of the flat tubular portion by receiving pressing force from the container body.

2. The squeeze container according to claim 1, wherein the longitudinal-direction reinforcing portion is a longitudinal-rib-form reinforcing portion.

3. The squeeze container according to claim 1, wherein the inner bag is attached to the inner portion of the container body in a position where a direction in which the bottom portion of the inner bag extends along the radial direction in which the pair of the longitudinal-direction reinforcing portions of the container body oppose one another.

4. The squeeze container according to claim 1, wherein the container body has a circular-cylindrical body portion.

5. The squeeze container according to claim 4, wherein:

a pair of non-pressed portions constituted by the longitudinal-direction reinforcing portions are present at respective two locations opposing one another in the radial direction of the circular-cylindrical body portion of the container body;

the pair of press-deforming portions each have a semi-circular cross-sectional shape, and are arranged in respective sections between the pair of longitudinal-direction reinforcing portions so as to oppose one another; and the non-pressed portions and the press-deforming portions serve as a squeezing-direction guiding apparatus that guides the squeezing direction so that a finger is placed on each of the pair of press-deforming portions and the press-deforming portions are squeezed in a direction in which the press-deforming portions approach one another.

6. The squeeze container according to claim 1, wherein:

the inner bag comprises:

a circular mouth portion having an outer diameter of a size conforming to an inner circumferential surface of a mouth/neck portion of the container body, a flexible deforming body portion that is continuous with the circular mouth portion, and the bottom portion which is closed via the deforming body portion;

the deforming body portion comprises:

a circular-cylindrical portion, and the flat tubular portion that gradually becomes fiat toward the bottom portion;

the flat tubular portion has a shape in which the cross-sectional area of the deforming body portion is reduced toward the bottom portion; and the inner bag is attached to the inner portion of the outer container in a suspended state by engaging the circular mouth portion to the mouth/neck portion.

7. The squeeze container according to claim 6, wherein, for the length of the major axis and the length of the minor axis in the cross section of the flat tubular portion of the deforming body portion of the inner bag, the flat tubular portion has a shape in which at least the length of the minor axis is reduced toward the bottom portion.

8. The squeeze container according to claim 6, wherein, in the flat tubular portion of the deforming body portion of the inner bag, a longitudinal-direction sectional shape at a lower end portion of a pair of side surfaces that oppose one another in the short width direction has a V-shape in a sectional view.

9. The squeeze container according to claim 8, wherein the bottom portion of the inner bag is connected such that the respective lower end portions of the pair of side surfaces that oppose one another in the short width direction in the flat tubular portion, which is continuous with the bottom portion on an upper side thereof, intersect with one another at an intersecting angle of from 20 to 90 degrees at the bottom portion.

10. The squeeze container according to claim 6, wherein the inner bag is formed by integrally molding or by coin-jection molding:

the circular mouth portion with a hard resin having shape retainability; and the deforming body portion and the bottom portion with a soft resin having flexibility.

11. The squeeze container according to claim 6, wherein the inner bag is formed such that:

the circular mouth portion made of a hard resin having shape retainability is molded as a separate member from the deforming body portion and the bottom portion made of a soft resin having flexibility; and the circular mouth portion is attached to and integrated with the deforming body portion and the bottom portion by attaching an upper end portion of the deforming body portion so as to cover an outer circumferential surface of the circular mouth portion.

12. The squeeze container according to claim 6, wherein:

an annular engagement flange is present and projects outward from an upper-end edge portion of the circular mouth portion; and the inner bag is attached to the inner portion of the outer container in a suspended state by arranging the annular engagement flange on an upper end surface of the mouth/neck portion.

13. The squeeze container according to claim 1, wherein:

the inner bag is attached to the inner portion of the container body that comprises a mouth/neck portion having a circular cross section; and an applicator-equipped cap having a check valve is attached so as to cover the mouth/neck portion of the container body.

14. The squeeze container according to claim 13, wherein the applicator-equipped cap is provided with a comb section that faces a direction along the radial direction in which the pair of the longitudinal-direction reinforcing portions of the container body oppose one another.

15. A squeeze container product, wherein the content is present in the inner bag of the squeeze container according to claim 1.

* * * * *